US006363350B1

(12) United States Patent
Lafe

(10) Patent No.: US 6,363,350 B1
(45) Date of Patent: Mar. 26, 2002

(54) METHOD AND APPARATUS FOR DIGITAL AUDIO GENERATION AND CODING USING A DYNAMICAL SYSTEM

(75) Inventor: Olurinde E. Lafe, Chesterland, OH (US)

(73) Assignee: Quikcat.com, Inc., Richmond Heights, OH (US)

( * ) Notice: Subject to any disclaimer, the term of this patent is extended or adjusted under 35 U.S.C. 154(b) by 0 days.

(21) Appl. No.: 09/474,313

(22) Filed: Dec. 29, 1999

(51) Int. Cl.[7] ..... G10L 21/00
(52) U.S. Cl. ..... 704/500; 704/201; 704/221
(58) Field of Search ..... 704/221, 201, 704/200, 202, 203, 500, 501, 504

(56) References Cited

U.S. PATENT DOCUMENTS 4,769,644 A * 9/1988 Frazier ..... 340/825.86
4,866,636 A 9/1989 Fukami et al. ..... 364/514
5,511,146 A * 4/1996 Simar, Jr. ..... 706/10
5,570,305 A 10/1996 Fattouche et al. ..... 364/715.02
5,611,038 A 3/1997 Shaw et al. ..... 395/806
5,677,956 A * 10/1997 Lafe ..... 380/28
5,680,462 A * 10/1997 Miller et al. ..... 380/263

* cited by examiner

*Primary Examiner*—David Hudspeth
*Assistant Examiner*—Abul K. Azad
(74) *Attorney, Agent, or Firm*—Michael A. Jaffe

(57) ABSTRACT

Digital audio is generated and coded using a multi-state dynamical system such as cellular automata. The rules of evolution of the dynamical system and the initial configuration are the key control parameters determining the characteristics of the generated audio. The present invention may be utilized as the basis of an audio synthesizer and as an efficient means to compress audio data.

41 Claims, 4 Drawing Sheets

METHOD AND APPARATUS FOR DIGITAL AUDIO GENERATION AND CODING USING A DYNAMICAL SYSTEM

FIELD OF INVENTION

The present invention relates generally to audio generation and coding, and more particularly relates to a method and apparatus for generating and coding digital audio data using a multi-state dynamical system, such as cellular automata.

BACKGROUND OF THE INVENTION

The need often arises to transmit digital audio data across communication networks (e.g., the Internet; the Plain Old Telephone System, POTS; Wireless Cellular Networks; Local Area Networks, LAN; Wide Area Networks, WAN; Satellite Communications Systems). Many applications also require digital audio data to be stored on electronic devices such as magnetic media, optical disks and flash memories. The volume of data required to encode raw audio data is large. Consider a stereo audio data sampled at 44100 samples per second and with a maximum of 16 bits used to encode each sample per channel. A one-hour recording of a raw digital music with that fidelity will occupy about 606 megabytes of storage space. To transmit such an audio file over a 56 kilobits per second communications channel (e.g., the rate supported by most POTS through modems), will take over 24.6 hours.

The best approach for dealing with the bandwidth limitation and also reduce huge storage requirement is to compress the audio data. A popular technique for compressing audio data combines transform approaches (e.g. the Discrete Cosine Transform, DCT) with a psycho-acoustic techniques. The current industry standard is the so-called MP3 format (or MPEG audio developed by the International Standards Organization International Electrochemical Committee, ISO/IEC) which uses the aforementioned approach. Various enhancements to the standard have been proposed. For example, Bolton and Fiocca, in U.S. Pat. No. 5,761,636, teach a method for improving the audio compression system by a bit allocation scheme that favors certain frequency subbands. Davis, in U.S. Pat. No. 5,699,484, teach a split-band perceptual coding system that makes use predictive coding in frequency bands.

Other audio compression inventions that are based on variations of the traditional DCT transform and/or some bit allocation schemes (utilizing perceptual models) include those taught by Mitsuno et al (U.S. Pat. No. 5,590,108), Shimoyoshi et al (U.S. Pat. No. 5,548,574), Johnston (U.S. Pat. No. 5,481,614), Fielder and Davidson (U.S. Pat. No. 5,109,417), Dobson (U.S. Pat. No. 5,819,215), Davidson et al (U.S. Pat. No. 5,632,003), Anderson et al (U.S. Pat. No. 5,388,181), Sudharsanan et al (U.S. Pat. No. 5,764,698) and Herre (U.S. Pat. No. 5,781,888).

Some recent inventions (e.g., Kurt et al in U.S. Pat. No. 5,819,215) teach the use of the wavelet transform as the tool for audio compression. The bit allocation schemes on the wavelet-based compression methods are generally based on the so-called embedded zero-tree concept taught by Shapiro (U.S. Pat. Nos. 5,321,776 and 5,412,741).

In order to achieve a better compression of digital audio data, the present invention makes use of a mapping method that uses dynamical systems. The evolving fields of cellular automata are used to generate "synthetic audio data." The rules governing the evolution of the dynamical system can be adjusted to produce synthetic audio data that satisfy the requirements of energy concentration in a few frequencies. One dynamical system is known as cellular automata transform (CAT), and is utilized in U.S. Pat. No. 5,677,956 by Lafe, as an apparatus for encrypting and decrypting data.

The present invention uses complex dynamical systems (e.g., cellular automata) to directly generate and code audio data. Special requirements are placed on generated data by favoring rule sets that result in predetermined audio characteristics.

SUMMARY OF THE INVENTION

According to the present invention there is provided a system for digital audio generation including the steps of determining a dynamical rule set; receiving input audio data; establishing a multi-state dynamical system using the input audio data as the initial configuration thereof; and evolving the input audio data in the dynamical system in accordance with the dynamical rule set for T time steps, to generate synthetic audio data.

According to another aspect of the present invention there is provided a method for coding digital audio data, including the steps of: receiving synthetic audio data; sampling an audio input to generate sampled audio data; and performing a forward transform to determine intensity weights associated with the synthetic audio data to reproduce the sampled audio data.

According to still another aspect of the present invention, there is provided a system for generating audio data comprising: means for determining a dynamical rule set; means for receiving input audio data; means for establishing a multi-state dynamical system using the input audio data as the initial configuration thereof; and means for evolving the input audio data in the dynamical system in accordance with the dynamical rule set for T time steps, to generate synthetic audio data.

According to yet another aspect of the present invention, there is provided a system for coding digital audio data, comprising: means for receiving synthetic audio data; means for sampling an audio input to generate sampled audio data; and means for performing a forward transform to determine intensity weights associated with the synthetic audio data to reproduce the sampled audio data.

An advantage of the present invention is the provision of a method and apparatus for audio data generation and coding which uses a dynamical system, such as cellular automata to generate audio data.

Another advantage of the present invention is the provision of a method and apparatus for audio data generation and coding, wherein the rule set governing evolution of the cellular automata can be selected to achieve audio data of specific frequency distribution.

Another advantage of the present invention is the provision of a method and apparatus for audio data generation and coding, wherein changes to the rule set governing evolution of the cellular automata results in the production of audio data of varying characteristics (e.g., frequency, timbre, duration, etc.).

Another advantage of the present invention is the provision of a method and apparatus for audio data generation and coding, wherein the rule set governing evolution of the cellular automata can be optimized so that audio data of a specified characteristic is reproduced.

Still another advantage of the present invention is the provision of a method and apparatus for audio data generation and coding which provides an efficient method for storing and/or transmitting audio data.

Still another advantage of the present invention is the provision of a method and apparatus for audio data generation and coding wherein evolving fields of a dynamical system correspond to data of desirable audio characteristics.

Still another advantage of the present invention is the provision of a method and apparatus for audio data generation and coding wherein the evolving fields of a dynamical system are utilized as the building blocks for coding digital audio.

Yet another advantage of the present invention is the provision of a method and apparatus for audio data generation and coding which provides an engine for producing synthetic sounds.

Still other advantages of the invention will become apparent to those skilled in the art upon a reading and understanding of the following detailed description, accompanying drawings and appended claims.

BRIEF DESCRIPTION OF THE DRAWINGS

The invention may take physical form in certain parts and arrangements of parts, a preferred embodiment and method of which will be described in detail in this specification and illustrated in the accompanying drawings which form a part hereof, and wherein.

DETAILED DESCRIPTION OF THE PREFERRED EMBODIMENT

It should be appreciated that while a preferred embodiment of the present invention will be described with reference to cellular automata as the dynamical system, other dynamical systems are also suitable for use in connection with the present invention, such as neural networks and systolic arrays.

In accordance with a preferred embodiment, the present invention teaches the generation of audio data from the evolutionary field of a dynamical system based on cellular automata. The rules governing the evolution of the cellular automata can be selected to achieve audio data of specific frequency distribution. Changing the rule sets results in the production of audio data of varying characteristics (e.g., frequency, timbre, duration, etc.). The rule set can also be optimized so that audio data of a specified characteristic is reproduced. This approach becomes an efficient method for storing and/or transmitting a given audio data. The rule sets are saved in the place of the original audio data. For playback the cellular automata is evolved using the identified rule sets.

The present invention uses a rule set for the evolution of cellular automata. The evolving fields of the dynamical system are shown to correspond to data of desirable audio characteristics. Such fields can be utilized as the building blocks for coding digital audio. The present invention can also be utilized as the engine for synthetic sounds. The present invention provides a means for changing the characteristics of the generated audio by manipulating the parameters associated with the coefficients required for operating the rule sets, as will be discussed in detail below.

Figure 1:
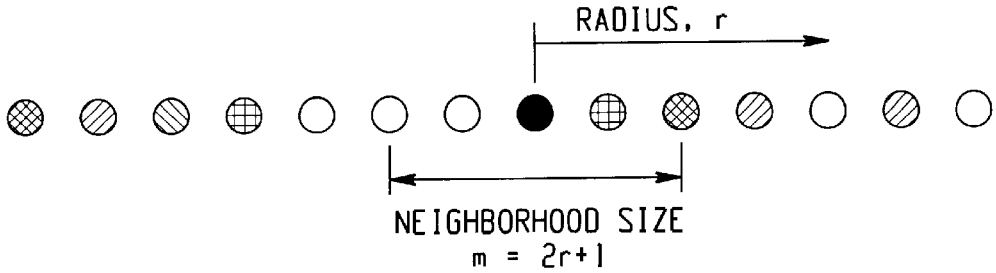
FIG. 1 is an illustration of a one-dimensional, multi-state cellular automation.

Referring now to the drawings wherein the showings are for the purposes of illustrating a preferred embodiment of the invention only and not for purposes of limiting same, FIG. 1 illustrates a one-dimensional, multi-state cellular automaton. Cellular Automata (CA) are dynamical systems in which space and time are discrete. The cells are arranged in the form of a regular lattice structure and must each have a finite number of states. These states are updated synchronously according to a specified local rule of interaction. For example, a simple 2-state 1-dimensional cellular automaton will include of a line of cells/sites, each of which can take value 0 or 1. Using a specified rule (usually deterministic), the values are updated synchronously in discrete time steps for all cells. With a K-state automaton, each cell can take any of the integer values between 0 and K−1. In general, the rule governing the evolution of the cellular automaton will encompass m sites up to a finite distance r away. Accordingly, the cellular automaton is referred to as a K-state, m-site neighborhood CA.

The number of dynamical system rules available for a given encryption problem can be astronomical even for a modest lattice space, neighborhood size, and CA state. Therefore, in order to develop practical applications, a system must be developed for addressing the pertinent CA rules. Consider, for an example, a K-state N-node cellular automaton with m=2r+1 points per neighborhood. Hence, in each neighborhood, if we choose a numbering system that is localized to each neighborhood, we have the following representing the states of the cells at time t: $a_{it}$ (i=0, 1, 2, 3, . . . m−1). We define the rule of evolution of a cellular automaton by using a vector of integers $W_j$ (j=0, 1, 2, 3, . . . , $2^m$) such that $$a_{(r)(t+1)} = \left(\sum_{j=0}^{2^m-2} W_j \alpha_j + W_{2^m-1}\right)^{W_{2^m}} \bmod K$$

where $0 \leqq W_j < K$ and $\alpha_j$ are made up of the permutations of the states of the cells in the neighborhood. To illustrate these permutations consider a 3-neighborhood one-dimensional CA. Since m=3, there are $2^3=8$ integer W values. The states of the cells are (from left-to-right) $a_{0k}$, $a_{1k}$, $a_{2k}$ at time t. The state of the middle cell at time t+1 is:

$$a_{1(t+1)}=(W_0a_{0t}+W_1a_{1t}+W_2a_{2t}+W_3a_{0t}a_{1t}+W_4a_{1t}a_{2t}+W_5a_{2t}a_{0t}+W_6a_{0t}a_{1t}a_{2t}W_w)^{W8} \bmod K \quad (1)$$

Hence, each set of $W_j$ results in a given rule of evolution. The chief advantage of the above rule-numbering scheme is that the number of integers is a function of the neighborhood size; it is independent of the maximum state, K, and the shape/size of the lattice.

A sample C code is shown in below for evolving one-dimensional cellular automata using a reduced set ($W^{2m}$=1) of the W-class rule system:

```
int EvolveCellularAutomata(int *a)
 {
        int i,j,seed,p,D=0,Nz=NeighborhoodSize-1,Residual;
        for (i=0;i<RuleSize;i+ +)
        {
             seed=1;p=1 <<Nz;Residual=i;
             for (j=Nz;j>=0;j- -)
             {
                  if (Residual >=p)
                  {
                       seed *= a[j];
                       Residual -= p;
                  }
                  if (seed = = 0) break;
                  p >>= 1;
             }
             D += (seed*W[i]);
        }
        return (D % STATE);
}
```

The above C-code evolves a one-dimensional CA for a given STATE and NeighborhoodSize. Vector {a} represents the states of the cells in the neighborhood. Rule size= $2^{NeighborhoodSize}$.

The parameters of the dynamical system rule set necessary for generating digital audio include:

1. The size, N, of the cellular automata space. This size is the number of cells in the dynamical system;
2. The number, m, of the cells in each neighborhood of the cellular automaton;
3. The maximum state, K, of the cellular automaton;
4. The W-set coefficients, $W_j$ (j=0, 1, 2, . . . $2^m$), of the rule set used for the evolution of the dynamical system; and
5. The initial configuration (or initial cell states) of the dynamical system. In one embodiment of the present invention, the key characteristics of the generated audio are independent of the initial configuration.

It is desired to generate digital audio data of duration D seconds having S samples per second, with each sample having a maximal value of $2^b$. The parameter, b, represents the number of bits required to encode the specific audio data. For example, if the generated audio data is to fit the characteristics of stereo CD-quality stereo music, S=44100 and b=16. In this case, the generated music constitutes one channel of the stereo audio. The other channel can be generated from a different dynamical rule set. For audio music in the mono mode b=8. The total number of samples required for a duration of D seconds is L=S×D.

One purpose of the present invention is to provide a method of generating a digital audio data sequence $f_i$ (i=0, 1, 2, . . . L−1) using a cellular automaton lattice of length N. The maximal value of the sequence f is $2^b$.

In accordance with a preferred embodiment of the present invention, the steps for generating f is as follows:

(1) Select the parameters of a dynamical system rule set, wherein the rule set includes:
   a) Size, m, of the neighborhood (in the example below m=3);
   b) Maximum state K of the dynamical system, which must be equal to the maximal value of the sample of the target audio data. Therefore $K=2^b$.
   c) W-set coefficients $W_j$ (j=0, 1, 2, . . . $2^m$) for evolving the automaton;
   d) Boundary conditions (BC) to be imposed. It will be appreciated that the dynamical system is a finite system, and therefore has extremities (i.e., end points). Thus, the nodes of the dynamical system in proximity to the boundaries must be dealt with. One approach is to create artificial neighbors for the "end point" nodes, and impose a state thereupon. Another common approach is to apply cyclic conditions that are imposed on both "end point" boundaries. Accordingly, the last data point is an immediate neighbor of the first. In many cases, the boundary conditions are fixed. Those skilled in the art will understand other suitable variations of the boundary conditions.
   e) The length N of the cellular automaton lattice space;
   f) The number of time steps, T, for evolving the dynamical system is D/N; and
   g) The initial configuration, $p_i$ (i=0, 1, 2, . . . N−1), for the cellular automaton. This is a set (total N) of numbers that start the evolution of the CA. The maximal value of this set of numbers is also $2^b$.

(2) Using the sequence p as the initial configuration, evolve the dynamical system using the rule set selected in (1).

(3) Stop the evolution at time t=T.

(4) To obtain the synthetic audio data, arrange the entire evolved field of the cellular automaton from time t=1 to time t=T. There are several methods for achieving this arrangement. If $a_{jt}$ is the state of the automaton at node j and time t, two possible arrangements are:
   (a) $f_i=a_{jt}$, where j=i mod N and t=(i−j)/N.
   (b) $f_i=a_{jt}$, where j=(i-t)/N and t=i mod T.

Those skilled in the art will recognize other permutations suitable for mapping the field a into the synthetic data f.

Figure 2:
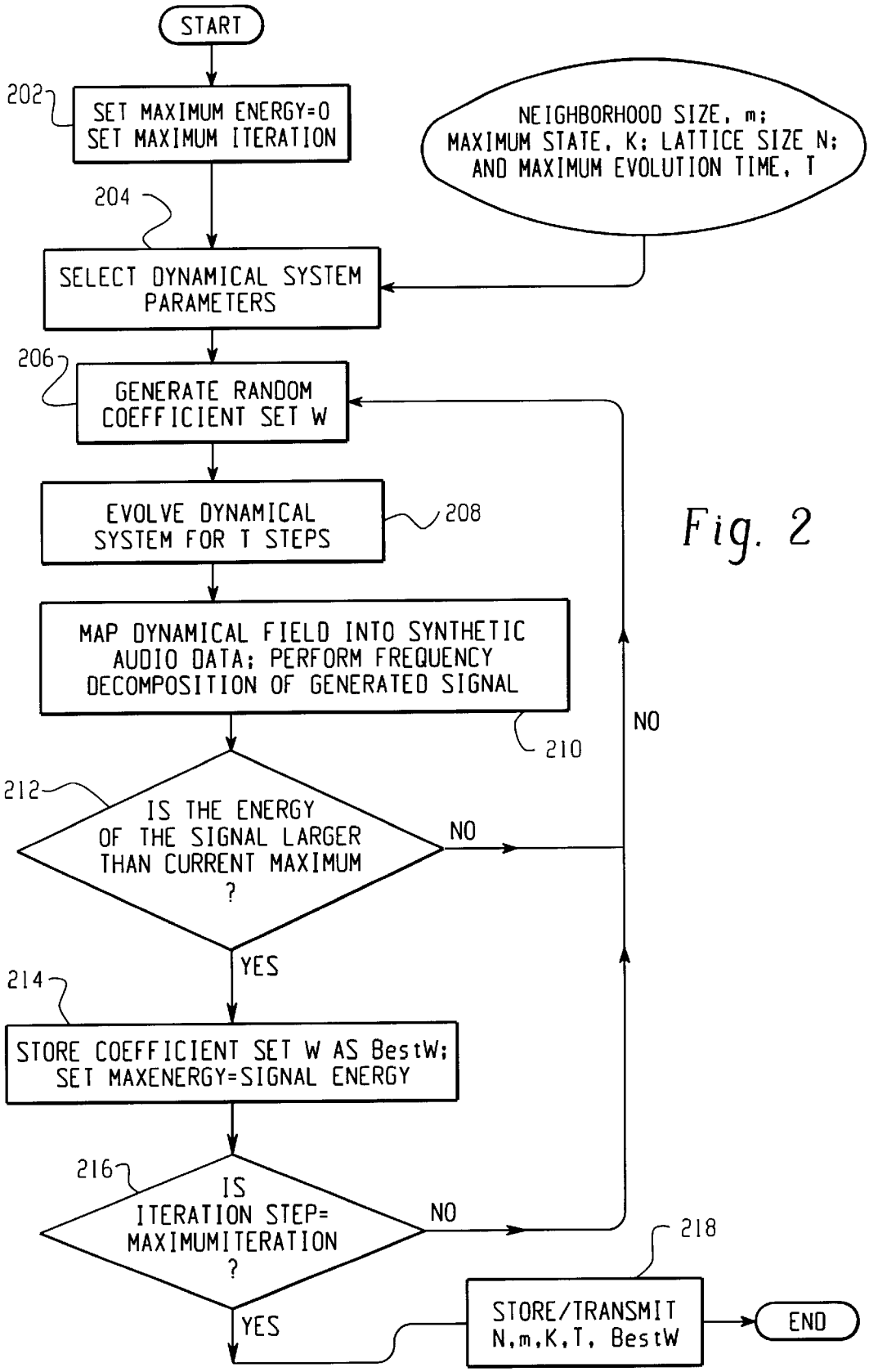
FIG. 2 is a block diagram of the steps involved in generating digital audio of distinct tonal characteristics, according to a preferred embodiment of the present invention.
Figure 3:
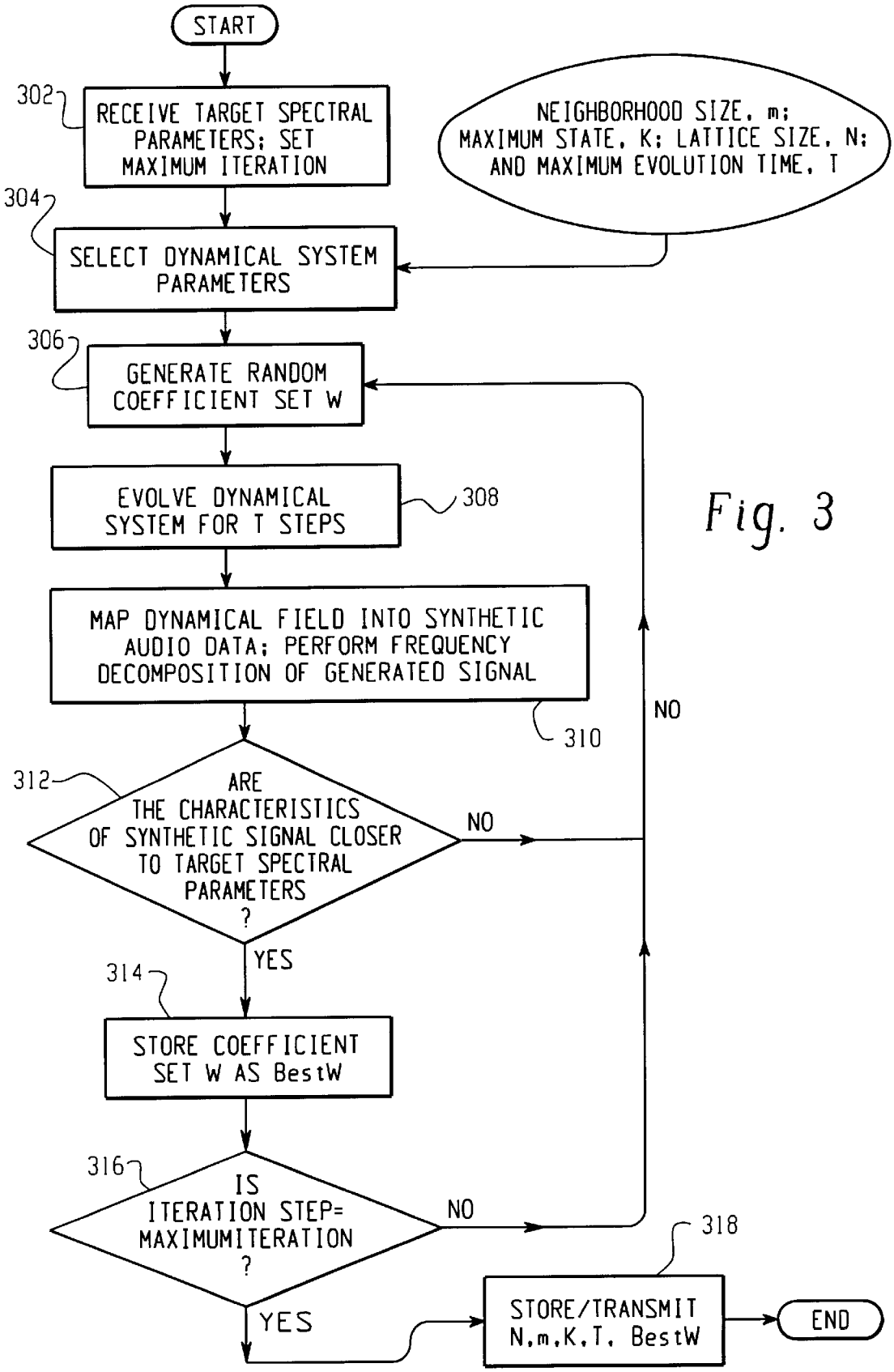
FIG. 3 is a block diagram of the steps involved in generating digital audio of pre-specified frequency characteristics, according to a preferred embodiment of the present invention.

Generation of synthetic audio of a specified frequency distribution and generation of synthetic audio of distinct tonal characteristics will now be described in detail with reference to FIGS. 2 and 3. The audio data generated in accordance with the process described in FIGS. 2 and 3 are suitable for use as "building blocks" for coding complex audio data which reproduces complex sounds, as will be described in detail below.

The generated sequence $f_i$ (i=0, 1, 2, . . . L−1) can be analyzed to determine the audio characteristics. A critical property of an audio sequence is the dominant frequencies. The frequency distribution can be obtained by performing the discrete Fourier transform on the data as:

$$F_n = \sum_{i=0}^{L-1} f_i e^{2\pi cn/L} \tag{2}$$

where n=0, 1, . . . L−1; and c=sqrt(−1). The audio frequency, $\phi_n$,(which is measured in Hertz) is related to the number n and the sampling rate S in the form:

$$\phi_n = \frac{n}{LS} \tag{3}$$

In accordance with a preferred embodiment of the present invention, audio data of a specific frequency distribution is generated as follows (FIG. 3):

(1) Perform the CA generation steps enumerated above (steps 302–308);

(2) Obtain the discrete Fourier transform of the generated data (step 310);

(3) Compare the frequency distribution of the generated data with target spectral parameters, and evaluate the discrepancy between the generated distribution and the target spectral parameters (step 312);

(4) If the discrepancy between the generated distribution and the target spectral parameters is closer than any previously obtained, then store the coefficient set W as BestW (step 314); otherwise generate another random coefficient set W (step 306), and continue with steps 308–312;

(5) Select a different set of randomly generated W-set coefficients W (step 306) and continue with steps 308–312 until the number of iterations exceeds a maximum limit (step 316); and (6) Store and/or transmit N, m, K, T, and BestW, wherein the BestW is a coefficient set W that provides the smallest discrepancy (step 318).

It should be appreciated that at rule set parameters other than the W-set coefficients may also be modified (e.g., neighborhood size, m; and lattice size, N). Moreover, it should be understood that audio data having a specific frequency distribution will produce a generally pure tone sound.

In accordance with a preferred embodiment of the present invention, audio data of a distinct tonal characteristics is generated as follows (FIG. 2):

(1) Perform the CA generation steps enumerated above (steps 202–208);

(2) Obtain the discrete Fourier transform of the generated data (step 210);

(3) Compare the energy of the obtained signal with the current maximum (MaxEnergy) (step 212);

(4) If the energy of the obtained signal is larger the current maximum, then store coefficient set W as BestW and set MaxEnergy equal to the energy of the obtained signal (step 214); otherwise generate another random coefficient set W (step 306), and continue with steps 208–212;

(5) Select a different set of randomly generated W-set coefficients W (step 206) and continue with steps 208–212 until the number of iterations exceeds a maximum limit (step 216); and (6) Store and/or transmit N, m, K, T, and BestW, wherein the BestW is a coefficient set W that provides the maximum energy (step 218).

It should be appreciated that at rule set parameters other than the W-set coefficients may also be modified (e.g., neighborhood size, m; and lattice size, N). Moreover, it should be understood that audio data having a distinct tonal characteristic will have concentrated energy in a limited number of frequencies. The resultant maximum energy is indicative of this concentrated energy.

Figure 6:
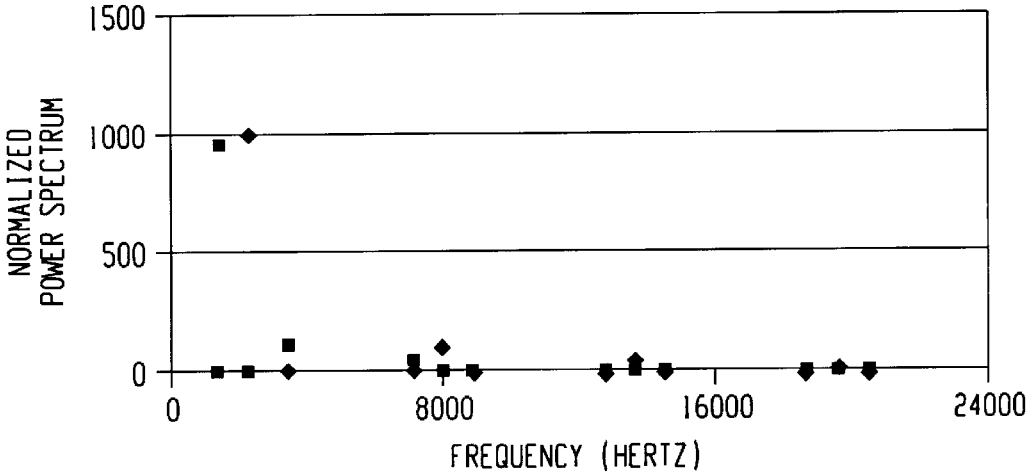
FIG. 6 is diagram of the power spectral plots of two synthetic audio data.

Referring now to FIG. 6, there is shown a diagram of the power spectral plots of two synthetic audio data, wherein normalized power, $(1000\ P)/P_{max}$, spectrum plots for N=8 (diamonds) and N=16 (squares)). The "keys" used in the evolution are:

(1) N=8,16;

(2) L=65536;

(3) W-set coefficients: See TABLE 1 below;

(4) Boundary Condition (BC): Cyclic; and (5) Initial Configuration: Zero everywhere.

TABLE 1

Audio Encoding W-set Coefficients

| $W_0$ | $W_1$ | $W_2$ | $W_3$ | $W_4$ | $W_5$ | $W_6$ | $W_7$ |
|---|---|---|---|---|---|---|---|
| 113 | 29 | 53 | 11 | 27 | 126 | 26 | 81 |

It should be observed in FIG. 6 how the change in the base width, N, causes a shift in the power spectrum distribution.

Figure 5:
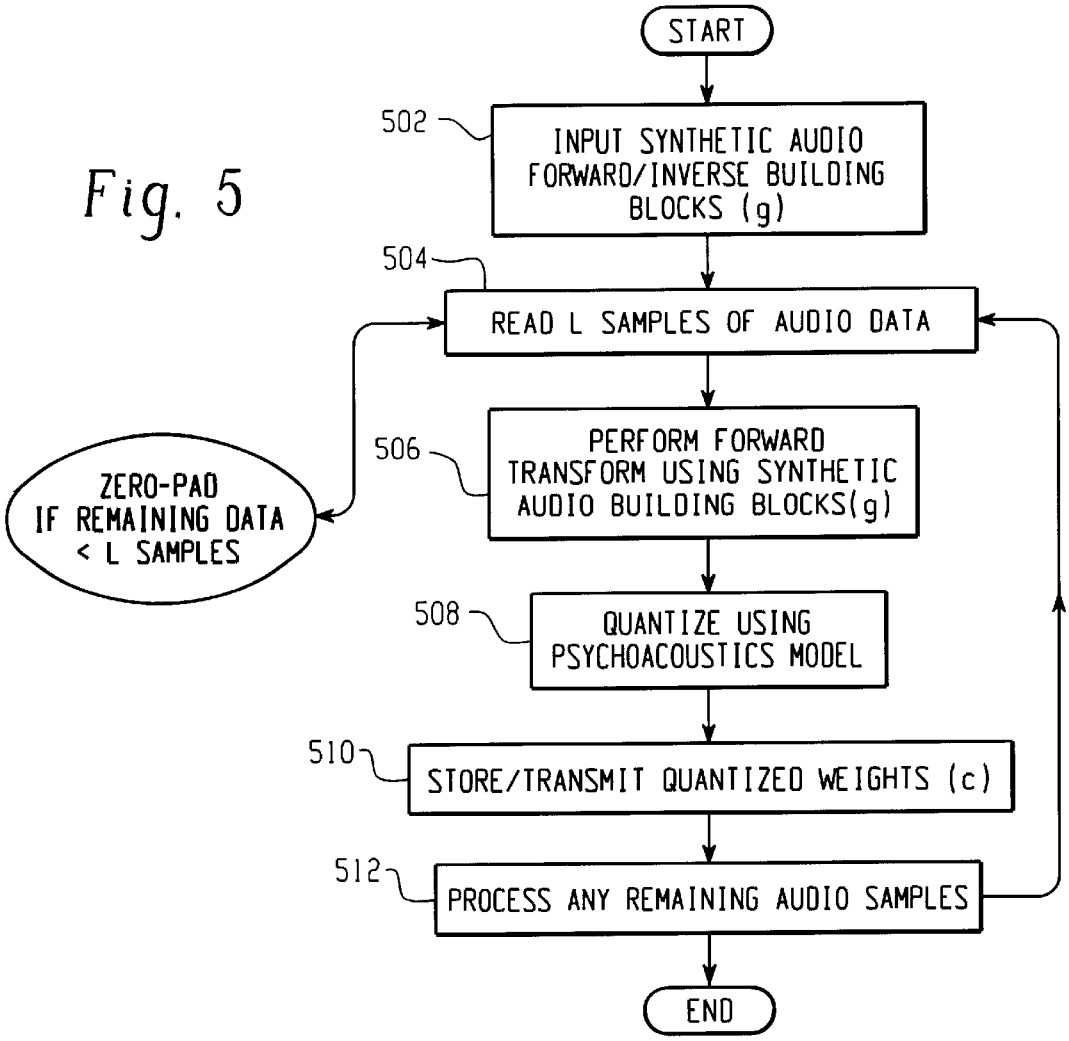
FIG. 5 is a block diagram of the steps used for coding digital audio in accordance with a preferred embodiment of the present invention.

Digital audio "coding" according to a preferred embodiment of the present invention, will now be described in detail with reference to FIG. 5. Consider the case where a specific audio data sequence $f_i$ (i=0, 1, 2, . . . L−1) is to be encoded. The objective is to find M synthetic CA audio data, g, such that:

$$f_i = \sum_{k=0}^{M-1} c_k g_{ik} \tag{4}$$

where $g_{ik}$ is the data generated at point i by k-th synthetic data, and $c_k$ is the intensity weight required in order to correctly encode the given audio sequence. It should be appreciated that that values for $g_{ik}$ are determined using one or both of the procedures described above in connection with FIGS. 2 and 3. In this regard, the $g_{ik}$ values are "building blocks," while $c_k$ are weighting values used to select appropriate quantities of each "building block."

The encoding parameters are:

(a) The W-set coefficients used for the evolution of each of the M synthetic data.

For example, if for a neighborhood 3, CA is used for all evolutions, then there are 8 W-set coefficients for each rule set;

(b) The width N of each automaton;

(c) The weights $c_k$ that measure the intensity. There are M of these.

Determination of intensity weights $c_k$ is described below.

In accordance with a preferred embodiment of the present invention, audio data is encoded as follows (FIG. 5):

(1) the synthetic audio "building blocks" g are input (step 502).

(2) samples of audio data to be coded are read (step 504).

(3) a forward transform using the synthetic audio building blocks g is performed (step 506). The building blocks g provide a catalog of predetermined sounds. The forward transform is used to compute the intensity weights $c_k$ associated with each building block g. To calculate the intensity weights, $c_k$, equation (4) is written in the matrix form:

$$\{f\}=[g]\{c\} \tag{5}$$

where {f} is a column matrix of size L; {c} is a column matrix of size M; and g is a rectangular matrix of size LM.

One approach is to use the least-squares method to determine {c} as:

$$\{c\} = [H]^{-1}\{r\} \tag{6}$$

$$H_{mk} = \sum_{i=0}^{L-1} g_{im} g_{ik}$$

-continued $$r_m = \sum_{i=0}^{L-1} f_i g_{im}$$

If the group of synthetic CA audio data $g_{ik}$ form an orthogonal set, then it is easy to calculate weight $c_k$ as:

$$c_k = \frac{1}{\lambda_k} \sum_{i=0}^{L-1} f_{ik} g_i \tag{8}$$

where $$\lambda_k = \sum_{i=0}^{L-1} g_{ik}^2$$

(4) The resulting data is quantized using a psychoacoustic model to selectively remove data unnecessary to produce a faithful reproduction of the original sampled audio data (step 508). For instance, those "g's" which (a) correspond to masked frequencies (i.e., cannot be heard by the human ear over other frequencies that are present), (b) correspond to frequencies that cannot be heard by the human ear, and (3) have a relatively small corresponding weight c, are discarded. Accordingly, the audio data is effectively compressed.

(5) the quantized weight c are stored and/or transmitted (step 510).

(6) any remaining audio data samples are processed as described above (step 512).

Figure 4:
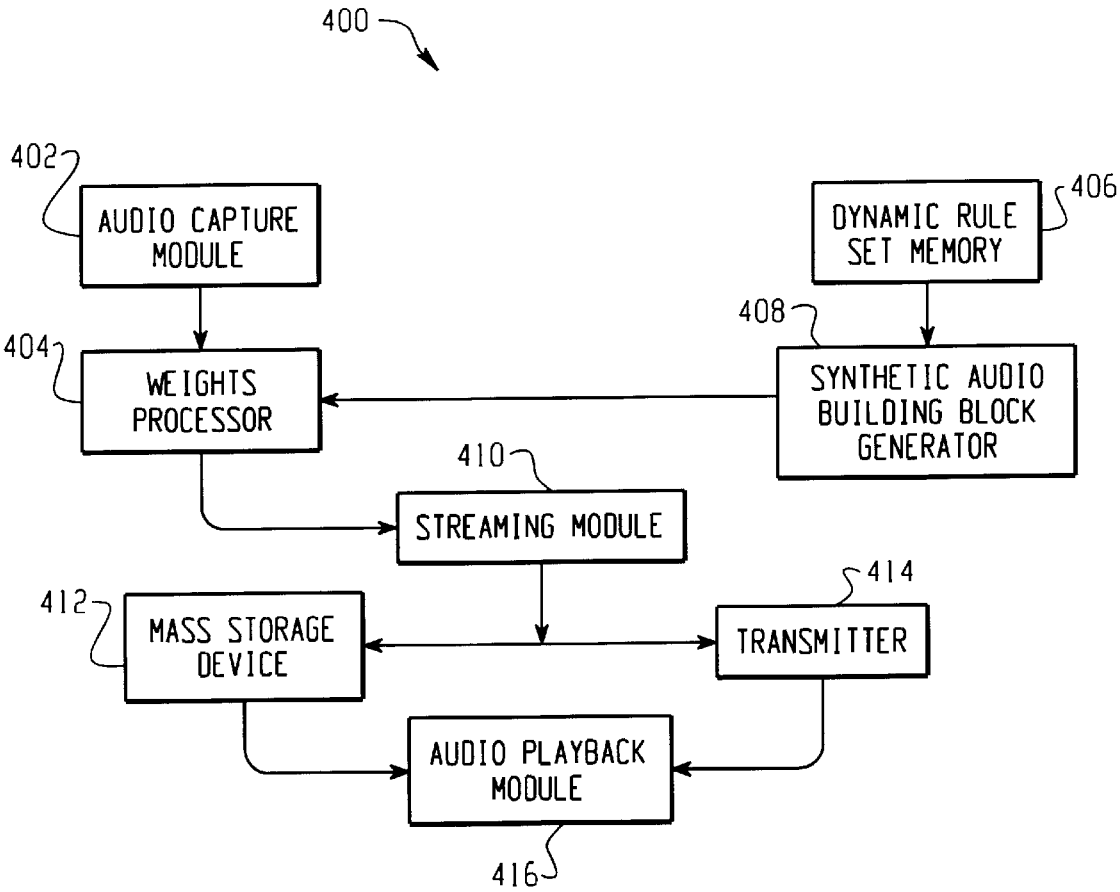
FIG. 4 is a block diagram of an exemplary apparatus in accordance with a preferred embodiment of the present invention.

Referring now to FIG. 4, there is shown a block diagram of an apparatus 400, according to a preferred embodiment of the present invention. Apparatus 400 is generally comprised of an audio capture module 402, a weight processor 404, a dynamical rule set memory 406, a synthetic audio building block generator 408, a streaming module 410, a mass storage device 412, a transmitter 414, and an audio playback module 416.

Audio capture module 402 preferably takes the form of a receiving device, which may receive analog audio source data (e.g., from a microphone) or digitized audio source data. The analog audio source data is converted to digital form using an analog-to-digital (A/D) converter. Weights processor 404 is a computing device (e.g., microprocessor) for computing the weights c associated with each "building block." Dynamical rule set memory 406 stores the rule set parameters for a dynamical system, and preferably takes the form of a random access memory (RAM). Synthetic audio building block generator 408 generates appropriate "building blocks" for reproducing particular audio data. Generator 408 preferably take the form a microprocessor programmed to implement a dynamical system (e.g., cellular automata). Streaming module 410 is used to convey synthetic audio data, and preferably takes the form of a bus or other communications medium. Mass storage device 412 is used to store synthetic audio data. Transmitter 414 is a communications device for transmitting synthetic audio data (e.g., modem, local area network, etc.). Audio playback module 416 preferably takes the form of a conventional "sound card" and speaker system for reproducing the sounds encoded by the synthetic audio data (e.g., using equation (4)).

It should be appreciated that apparatus 400 is exemplary, and numerous suitable substitutes may be alternatively implemented by those skilled in the art.

In conclusion, the present invention discloses efficient means of generating audio data by using the properties of a multi-state dynamical system, which is governed by a specified rule set that is a function of permutations of the cell states in neighborhoods of the system.

The invention has been described with reference to a preferred embodiment. Obviously, modifications and alterations will occur to others upon a reading and understanding of this specification. It is intended that all such modifications and alterations be included insofar as they come within the scope of the appended claims or the equivalents thereof.

What is claimed is:

1. A method of generating audio data comprising:

(a) determining a dynamical rule set comprised of a plurality of parameters;

(b) receiving input audio data respectively having a plurality of characteristics;

(c) evolving a multi-state dynamical system in accordance with the dynamical rule set for T time steps, to generate synthetic audio data respectively having a plurality of characteristics, wherein said multi-state dynamical system is cellular automata, said T time steps is determined from the duration D of the input audio data and size N of the dynamical system, wherein T=D/N;

(d) comparing at least one characteristic of the input audio data to at least one characteristic of the synthetic audio data, to provide a comparison result;

(e) modifying at least one parameter of the dynamical rule set in response to the comparison result; and (f) repeating steps (c), (d) and (e) until a predetermined criterion is met.

2. A method according to claim 1, wherein said predetermined criterion is the comparison result with a predetermined threshold.

3. A method according to claim 2, wherein at least one of the parameters of the dynamical rule set is randomly generated.

4. A method according to claim 1, wherein said predetermined criterion is a predetermined number of iterations of steps (c), (d) and (e).

5. A method according to claim 1, wherein said at least one characteristic of the input audio data and the at least one characteristic of the synthetic audio data is waveform.

6. A method according to claim 1, wherein said at least one characteristic of the input audio data and the at least one characteristic of the synthetic audio data is frequency.

7. A method according to claim 1, wherein said parameters of the dynamical rule set includes W-set coefficients, lattice size N of the dynamical system, a neighborhood size m of the dynamical system, a maximum state K of the dynamical system, and boundary conditions BC of the dynamical system.

8. A method according to claim 1, wherein said method further comprises the step of storing the dynamical rule set, determined in accordance with the predetermined criterion, as the code for the synthetic audio data approximating the input audio data.

9. A method according to claim 1, wherein said method further comprises the step of transmitting the dynamical rule set, determined in accordance with the predetermined criterion, as the code for the synthetic audio data approximating the input audio data.

10. A method according to claim 1, wherein said method further comprises:

receiving said synthetic audio data;

sampling an audio input to generate sampled audio data; and performing a forward transform to determine intensity weights associated with the synthetic audio data to reproduce the sampled audio data.

11. A method according to claim 10, wherein said method further comprises at least one of: storing the intensity weights, and transmitting the intensity weights.

12. A method according to claim 10, wherein said method further comprises quantizing said intensity weights to form quantized intensity weights.

13. A method according to claim 12, wherein said method further comprises at least one of: storing said quantized intensity weights, and transmitting said quantized intensity weights.

14. A method according to claim 12, wherein said intensity weights associated with masked and humanly unhearable frequencies are discarded, using a psycho-acoustic model.

15. A method according to claim 10, wherein said step of performing a forward transform includes utilizing a least-squares method.

16. A method for generating synthetic audio data of a distinct tonal characteristic comprising the steps of:

(a) selecting a dynamical rule set comprised of a plurality of parameters;

(b) evolving a dynamical system for T time steps using the dynamical rule set to generate synthetic audio data, wherein said dynamical system is cellular automata, said T time steps is determined from the duration D of the input audio data and size N of the dynamical system, wherein T=D/N;

(c) decomposing the synthetic audio data;

(d) determining an energy value associated with the synthetic audio data;

(e) comparing the energy value associated with the synthetic audio data with a stored energy value, wherein if the energy value associated with the synthetic audio data is larger than the stored energy value, then storing the energy value associated with the synthetic audio data as the stored energy value, and (f) modifying at least one parameter of the dynamical rule set; and (g) repeating steps (b)–(f) for a maximum number of iterations.

17. A method according to claim 12, wherein said method further comprises storing said at least one parameter of the dynamical rule set associated with the stored energy value.

18. A method according to claim 12, wherein said method further comprises transmitting said at least one parameter of the dynamical rule set associated with the stored energy value.

19. A method for generating synthetic audio data of a distinct tonal characteristic comprising the steps of:

(a) selecting a dynamical rule set comprised of a plurality of parameters;

(b) evolving a dynamical system for T time steps using the dynamical rule set to generate synthetic audio data, wherein said dynamical system is cellular automata, said T time steps is determined from the duration D of the input audio data and size N of the dynamical system, wherein T=D/N;

(c) decomposing the synthetic audio data;

(d) comparing frequency characteristics of the decomposed synthetic audio data to target spectral parameters, wherein if the frequency characteristics associated with the synthetic audio data is closer to the target spectral parameters than previously obtained with a previous dynamical rule set, then storing at least one of the parameters of the dynamical rule set and (e) modifying at least one parameter of the dynamical rule set; and (f) repeating steps (b)–(e) for a maximum number of iterations.

20. A method according to claim 16, wherein said method further comprises storing said at least one parameter of the dynamical rule set associated with said frequency characteristics closest to the target spectral parameters.

21. A method according to claim 16, wherein said method further comprises transmitting said at least one parameter of the dynamical rule set associated with said frequency characteristics closest to the target spectral parameters.

22. A system for generating audio data comprising:

(a) means for determining a dynamical rule set comprised of a plurality of parameters;

(b) means for receiving input audio data respectively having a plurality of characteristics;

(c) means for evolving a multi-state dynamical system in accordance with the dynamical rule set for T time steps, to generate synthetic audio data, respectively having plurality of characteristics, wherein said multi-state dynamical system is cellular automata, said T time steps is determined from the duration D of the input audio data and size N of the dynamical system, where T=D/N;

(d) means for comparing at least one characteristic of the input audio data to at least one characteristic of the synthetic audio data to provide a comparison result; and (e) means for modifying at least one parameter of the dynamical rule set in response to the comparison result, said at least one parameter of the dynamical rule set is subject to modification until a predetermined criterion is met.

23. A system according to claim 22, wherein said predetermined criterion is the comparison result with a predetermined threshold.

24. A system according to claim 23, wherein said at least one of the parameters of the dynamical rule set is randomly generated.

25. A system according to claim 22, wherein said predetermined criterion is a maximum number of comparison results.

26. A system according to claim 22, wherein said at least one characteristic of the input audio data and the at least on characteristic of the synthetic audio data is a waveform.

27. A system according to claim 22, wherein said at least one characteristic of the input audio data and the at least one characteristic of the synthetic audio data is frequency.

28. A system according to claim 22, wherein said parameters of the dynamical rule set includes W-set coefficients, lattice size N of the dynamical system, a neighborhood size m of the dynamical system, a maximum state K of the dynamical system, and boundary conditions BC of the dynamical system.

29. A system according to claim 22, wherein said system further comprises means for storing the dynamical rule set, as determined in accordance with the predetermined criterion, as the code for the synthetic audio data approximating the input audio data.

30. A system according to claim 22, wherein said system further comprises means for transmitting the dynamical rule set, as determined in accordance with the predetermined criterion, as the code for the synthetic audio data approximating the input audio data.

31. A system according to claim 22, wherein said system further comprises:

means for receiving said synthetic audio data;

means for sampling an audio input to generate sampled audio data; and means for performing a forward transform to determine intensity weights associated with the synthetic audio data to reproduce the sampled audio data.

32. A system according to claim 31, wherein said system further comprises at least one of: means for storing the intensity weights, and means for transmitting the intensity weights.

33. A system according to claim 31, wherein said system further comprises means for quantizing said intensity weights to form quantized intensity weights.

34. A system according to claim 33, wherein said system further comprises data compression means for discarding intensity weights associated with masked and humanly unhearable frequencies, using a psycho-acoustic model.

35. A system according to claim 31, wherein said system further comprises at least one of: means for storing said quantized intensity weights, and means for transmitting said quantized intensity weights.

36. A system for generating synthetic audio data of a distinct tonal characteristic comprising:

(a) means for selecting a dynamical rule set comprised of a plurality of parameters;

(b) means for evolving a dynamical system for T time steps using the dynamical rule set to generate synthetic audio data, wherein said dynamical system is cellular automata; said T time steps is determined from the duration D of the input audio data and size N of the dynamical system, wherein T=D/N;

(c) means for decomposing the synthetic audio data;

(d) means for determining an energy vale associated with the synthetic audio data;

(e) means for comparing the energy value associated with the synthetic audio data with a stored energy value, wherein if the energy value associated with the synthetic audio data is larger than the stored energy value, then storing the energy value associated with the synthetic audio data as the stored energy value, and (f) means for modifying at least one parameter of the dynamical rule set for a maximum number of iterations.

37. A system according to claim 36, wherein said system further comprises means for storing said at least one parameter of the dynamical rule set associated with the stored energy value.

38. A system according to claim 36, wherein said system further comprises means for transmitting said at least one parameter of the dynamical rule set associated with the stored energy value.

39. A system for generating synthetic audio data of a distinct tonal characteristic comprising:

(a) selecting a dynamical rule set comprised of a plurality of parameters;

(b) evolving a dynamical system for T time steps using the dynamical rule set to generated synthetic audio data, wherein said dynamical system is cellular automata, said T time steps is determined from the duration D of the input audio data and size N of the dynamical system, wherein T=D/N;

(c) means for decomposing the synthetic audio data;

(d) means for comparing frequency characteristics of the decomposed synthetic audio data to target spectral parameters, wherein if the frequency characteristics associated with the synthetic audio data is closer to the target spectral parameters than previously obtained with a previous dynamical rule set, then storing at least one of the parameters of the dynamical rule set, and (e) modifying at least one parameter of the dynamical rule set for a maximum number of iterations.

40. A system according to claim 39, wherein said system further comprises means for storing said at least one parameter of the dynamical rule set associated with said frequency characteristics closest to the target spectral parameters.

41. A system according to claim 39, wherein said system further comprises means for transmitting said at least one parameter of the dynamical rule set associated with said frequency characteristics closest to the target spectral parameters.

* * * * *